US010521973B2

(12) United States Patent
Bekas et al.

(10) Patent No.: US 10,521,973 B2
(45) Date of Patent: Dec. 31, 2019

(54) SYSTEM FOR MONITORING AND ENFORCEMENT OF AN AUTOMATED FEE PAYMENT

(71) Applicant: International Business Machines Corporation, Armonk, NY (US)

(72) Inventors: Konstantinos Bekas, Horgen (CH); Martin Rufli, Winterthur (CH)

(73) Assignee: International Business Machines Corporation, Armonk, NY (US)

( * ) Notice: Subject to any disclaimer, the term of this patent is extended or adjusted under 35 U.S.C. 154(b) by 656 days.

(21) Appl. No.: 14/972,696

(22) Filed: Dec. 17, 2015

(65) Prior Publication Data

US 2017/0178417 A1 Jun. 22, 2017

(51) Int. Cl.
*G07B 15/06* (2011.01)

(52) U.S. Cl.
CPC ..... *G07B 15/063* (2013.01)

(58) Field of Classification Search
CPC ..... G07B 15/063
USPC ..... 705/13
See application file for complete search history.

(56) References Cited

U.S. PATENT DOCUMENTS 8,473,332 B2 6/2013 Robinson et al.
8,558,696 B2 10/2013 Baumann et al.
8,587,454 B1 11/2013 Dearworth
8,688,525 B2 4/2014 Minde
8,775,236 B2 7/2014 Hedley et al.
8,896,468 B2 11/2014 Gartner et al.
2002/0147658 A1* 10/2002 Kwan ..... G06Q 20/04 705/16
2004/0148518 A1 7/2004 Grundback et al.
(Continued)

FOREIGN PATENT DOCUMENTS

CN 101553848 A 10/2009
WO 2013003524 A1 1/2013
(Continued)

OTHER PUBLICATIONS

RFID Based Toll Collection System, International Journal of Computer Science and Information Technologies (Year: 2014).*
(Continued)

*Primary Examiner* — Jeff Zimmerman
*Assistant Examiner* — Zeina Elchanti
(74) *Attorney, Agent, or Firm* — Edward P. Li

(57) ABSTRACT

A method, a computer program product, and a computer system for monitoring and enforcing an automated fee payment in an infrastructure. A mobile device on a verifier's vehicle monitors a record of a transaction of a payment on a distributed ledger. The payment is paid for using a service of the infrastructure and by a mobile device on an infrastructure user's vehicle. The mobile device on the verifier's vehicle captures information of the transaction of the payment and the infrastructure user's vehicle. The information is broadcasted by the mobile device on the infrastructure user's vehicle. The mobile device on the verifier's vehicle determines whether there is a valid transaction of the payment for the service. The mobile device on the verifier's vehicle sends a violation record to an offense reporting address of an infrastructure provider, in response to determining that there is no valid transaction of the payment.

18 Claims, 8 Drawing Sheets

(56) References Cited

U.S. PATENT DOCUMENTS

2011/0159861 A1* 6/2011 Pratt ..... H04L 63/0407 455/417
2011/0208600 A1* 8/2011 Aharoni ..... G06Q 20/20 705/16
2013/0006775 A1* 1/2013 Jordan ..... G08G 1/20 705/14.62
2013/0132166 A1 5/2013 Wu et al.
2013/0201034 A1* 8/2013 Leopold ..... G07B 15/06 340/902
2014/0132763 A1 5/2014 Billau et al.
2014/0214499 A1 7/2014 Hudson et al.
2014/0379475 A1* 12/2014 Sarangi ..... G06Q 30/0266 705/14.56
2015/0135336 A1* 5/2015 Arasavelli ..... H04B 7/26 726/29
2015/0154578 A1* 6/2015 Aggarwal ..... G06Q 20/145 705/13
2015/0178640 A1* 6/2015 Balakrishnan ..... G06Q 50/30 705/13
2016/0055466 A1* 2/2016 Du ..... G06O 20/145 705/13
2016/0097648 A1* 4/2016 Hannah ..... G06K 9/00785 701/118
2017/0046664 A1* 2/2017 Haldenby ..... G06Q 20/0655
2017/0164178 A1* 6/2017 Anjum ..... G08G 1/017
2018/0341937 A1* 11/2018 Kim ..... G06Q 20/16

FOREIGN PATENT DOCUMENTS

WO 2013190566 A2 12/2013
WO 2015024126 A1 2/2015

OTHER PUBLICATIONS

Buterin, Vitalik; "How Anonymous Money Can Support Efficient Government Revenue Collection"; Jul. 2, 2013; pp. 1-6; <http://bitcoinmagazine.com/5579/how-anonymous-money-can-support-efficeint-government-revenue-collection/>.

Unknown; "Electronic Toll Collection System Market by Type, Product, Technology, Application and Geography—Analysis & Forecast"; ReportLinker; Jun. 2015—MarketsandMarkets; Printed Sep. 8, 2015; pp. 1-2; <http://www.reportlinker.com/p03024661-summary/electronic-Toll-Collec . . .>.

* cited by examiner

SYSTEM FOR MONITORING AND ENFORCEMENT OF AN AUTOMATED FEE PAYMENT

BACKGROUND

The present invention relates generally to an electronic payment system, and more particularly to a system for monitoring and enforcement of an automated fee payment in an infrastructure.

Urban road congestion represents a major and growing problem in most global cities—with a worldwide associated cost estimated in hundreds of billions of dollars per year. Many cities in the world have introduced static road toll systems, but they are expensive to install and maintain infrastructures, difficult to upgrade as sensing & communication technology progresses, and inflexible in their application.

A typical electronic toll collection (ETC) system includes four subsystems called automatic vehicle classification (AVC), violation enforcement system (VES), automatic vehicle identification (AVI), and transaction processing which includes a back office and integration. It relies on a stationary infrastructure.

Bitcoin is a digital store of value and payment system. The system is peer-to-peer; users can transact directly without needing an intermediary. Transactions are verified by network nodes and recorded in a distributed ledger. Bitcoin has been proposed as a standard protocol to handle road tolling transactions.

SUMMARY

In one aspect, a method for monitoring and enforcing an automated fee payment in an infrastructure is provided. The method is implemented by a computer. In the method, a mobile device on a vehicle of a verifier monitors a record of a transaction of a payment on a distributed ledger, wherein the payment is paid for using a service of the infrastructure and paid by a mobile device on a vehicle of an infrastructure user. In the method, the mobile device on the vehicle of the verifier captures information of the transaction of the payment and the vehicle of the infrastructure user, wherein the information is broadcasted by the mobile device on the vehicle of the infrastructure user. In the method, the mobile device on the vehicle of the verifier determines whether there is a valid transaction of the payment for the service. In the method, the mobile device on the vehicle of the verifier sends a violation record to an offense reporting address of an infrastructure provider, in response to determining that there is no valid transaction of the payment for the service.

In another aspect, a computer program product for monitoring and enforcing an automated fee payment in an infrastructure is provided. The computer program product comprises a computer readable storage medium having program code embodied therewith. The program code is executable to: monitor, by a mobile device on a vehicle of a verifier, a record of a transaction of a payment on a distributed ledger, wherein the payment is paid for using a service of the infrastructure and paid by a mobile device on a vehicle of an infrastructure user; capture, by the mobile device on the vehicle of the verifier, information of the transaction of the payment and the vehicle of the infrastructure user, wherein the information is broadcasted by the mobile device on the vehicle of the infrastructure user; determine, by the mobile device on the vehicle of the verifier, whether there is a valid transaction of the payment for the service; and send, by the mobile device on the vehicle of the verifier, a violation record to an offense reporting address of an infrastructure provider, in response to determining that there is no valid transaction of the payment for the service.

In yet another aspect, a computer system for monitoring and enforcing an automated fee payment in an infrastructure is provided. The computer system comprises one or more processors, one or more computer readable tangible storage devices, and program instructions stored on at least one of the one or more computer readable tangible storage devices for execution by at least one of the one or more processors. The program instructions are executable to monitor, by a mobile device on a vehicle of a verifier, a record of a transaction of a payment on a distributed ledger, wherein the payment is paid for using a service of the infrastructure and paid by a mobile device on a vehicle of an infrastructure user. The program instructions are executable to capture, by the mobile device on the vehicle of the verifier, information of the transaction of the payment and the vehicle of the infrastructure user, wherein the information is broadcasted by the mobile device on the vehicle of the infrastructure user. The program instructions are executable to determine, by the mobile device on the vehicle of the verifier, whether there is a valid transaction of the payment for the service. The program instructions are executable to send, by the mobile device on the vehicle of the verifier, a violation record to an offense reporting address of an infrastructure provider, in response to determining that there is no valid transaction of the payment for the service.

DETAILED DESCRIPTION

The embodiments of the present invention employ advances in vehicle instrumentation (including sensing and communication) and distributed ledger technology (for example Bitcoin), and combine them into a system that enables the automation of road tolling and other fee payment. The system is novel, privacy preserving, and cost-efficient.

The embodiments of the present invention disclose a novel system enabling real-time and dynamically adaptive tolling and other fee collection (e.g., for parking fee collection). The system is without the installation of dedicated physical and/or trusted infrastructure. Payment for toll road or parking space usage is conducted via an e-currency and verified by verifiers (such as police cars) via computerized vision using cameras and a network connection.

The embodiments of the present invention disclose a system that has interactions among three entities: an infrastructure provider (e.g., a city), an infrastructure user (e.g., a car driver), and a verifier (e.g., police). The infrastructure provider implements and/or interfaces with a distributed ledger (for example Bitcoin's block chain) where financial transactions can be executed and recorded. Distributed verification of transactions is not necessary (for example, the city can provide a public ledger), but it is certainly useful to establish trust. The infrastructure provider sets up different addresses where payments for different services are to be received. Examples of such services include express lanes using dynamic tolls and demand-responsive parking. The infrastructure user (e.g., a car driver) generates a plurality of one-time addresses that are not traceable to the infrastructure user's identity and funds the plurality of one-time addresses with some money. Non-traceability can be, for example, accomplished via hierarchic deterministic wallets derivable from a seed. Funding the plurality of one-time addresses can then be completed via a mixing service to avoid tracing via the transaction history.

Figure 1:
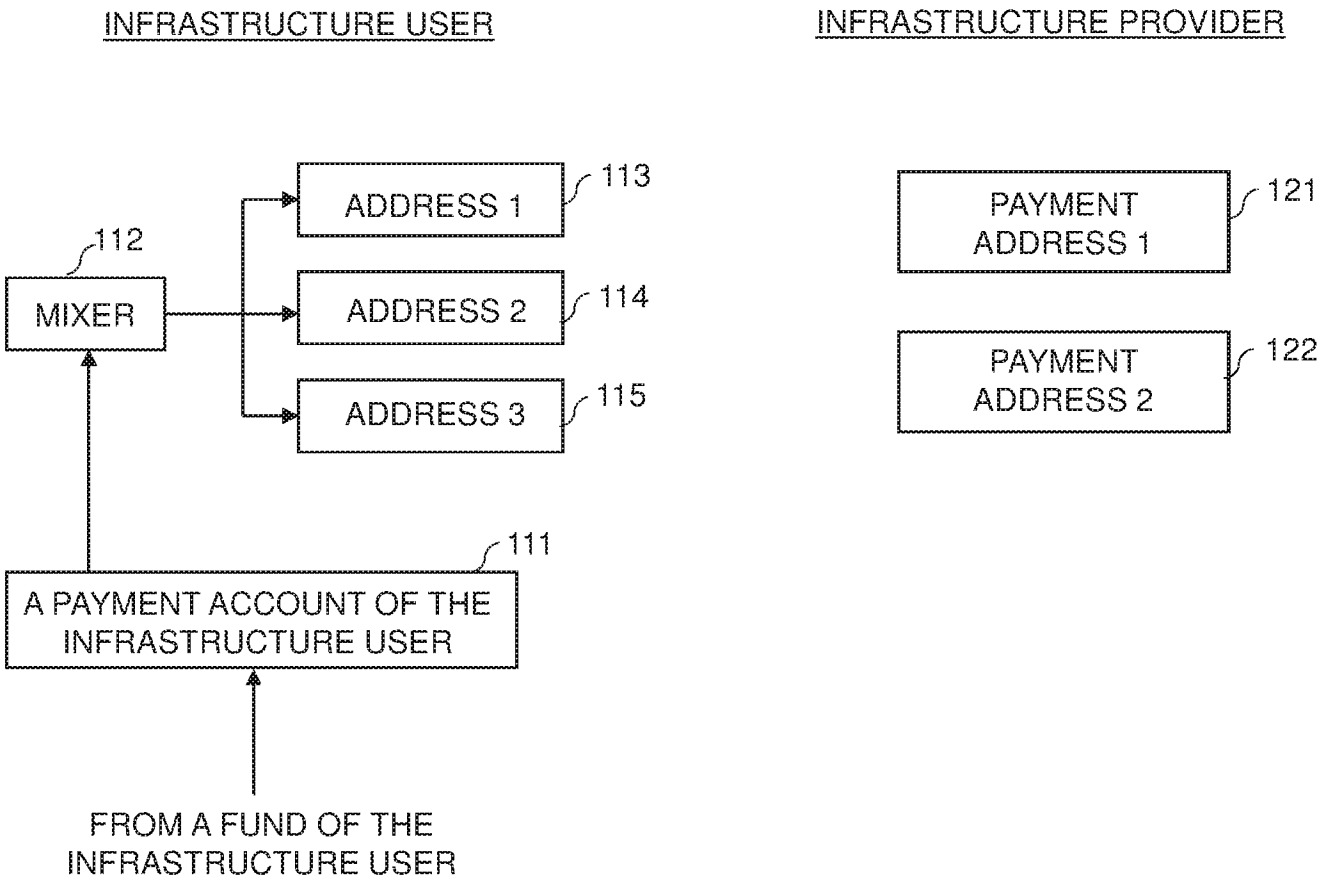
FIG. 1 is a diagram showing an electronic payment system including one-time anonymous addresses of an infrastructure user and addresses of an infrastructure provider, in accordance with one embodiment of the present invention.

FIG. 1 is a diagram showing an electronic payment system including one-time anonymous addresses of an infrastructure user and payment addresses of an infrastructure provider, in accordance with one embodiment of the present invention. FIG. 1 shows an example of a plurality of one-time anonymous addresses for an infrastructure user; only three such addresses are shown as demonstration. In the example, the one-time anonymous addresses for the infrastructure user include address 1 113, address 2 114, and address 3 115. The amount of money in each address is set to be small enough ("micropayment") so that an address can be used only one time for one payment and then another address must be used for just one time for another payment. FIG. 1 shows an example of one or more payment addresses of the infrastructure provider; two such addresses are shown as demonstration. In the example, two payment addresses for the infrastructure provider include payment address 1 121 and payment address 2 122. Payment account 111 of the infrastructure user is funded from a fund of the infrastructure user, for example a bank account of the infrastructure user. Funding address 1 113, address 2 114, and address 3 115 is completed via mixer 112 (a mixing service) to avoid tracing via the transaction history.

Figure 2:
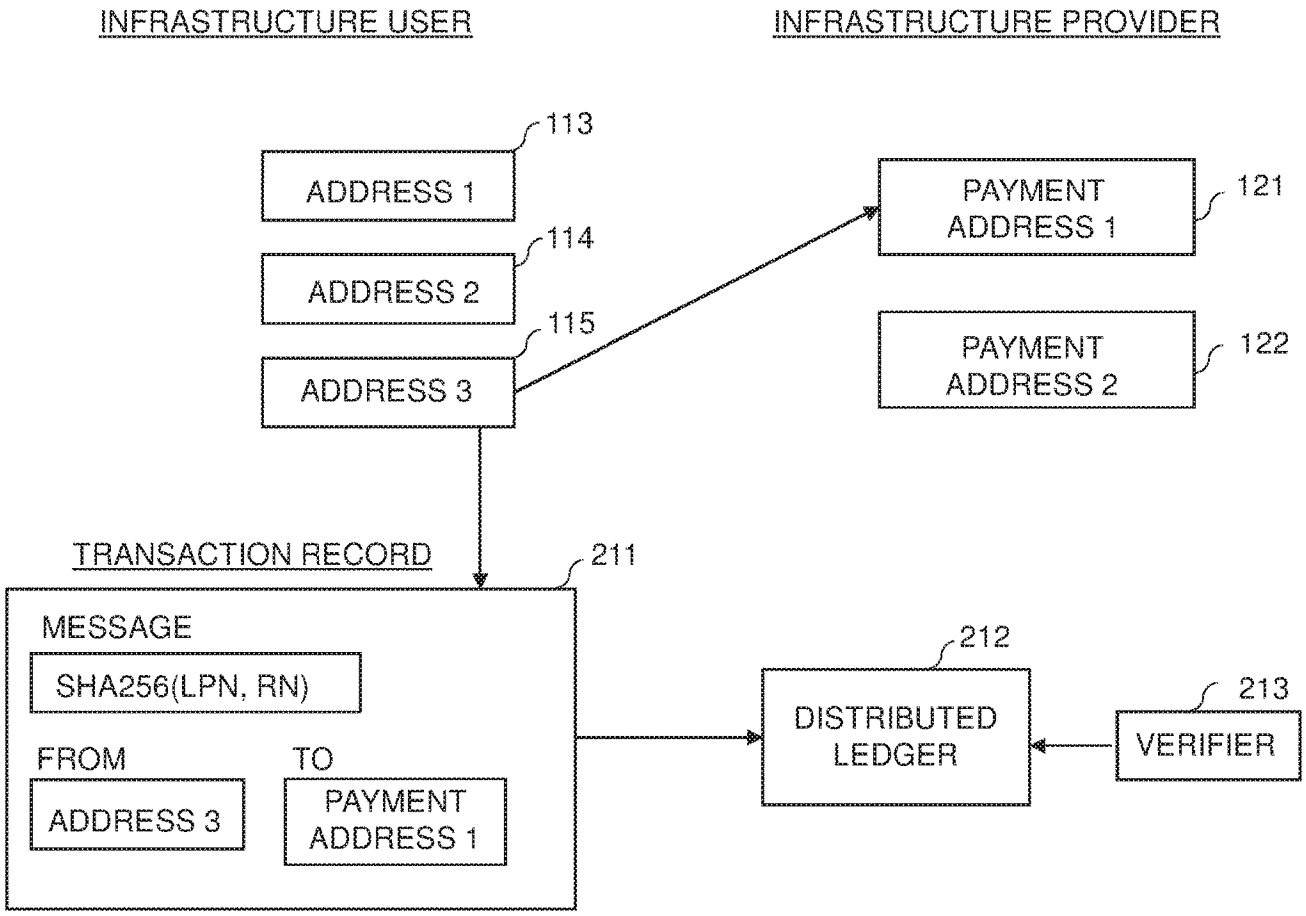
FIG. 2 is a diagram showing a payment transaction from a one-time anonymous address of an infrastructure user to a payment address of an infrastructure provider, in accordance with one embodiment of the present invention.

FIG. 2 is a diagram showing a payment transaction from a one-time anonymous address of an infrastructure user to a payment address of an infrastructure provider, in accordance with one embodiment of the present invention. FIG. 2 shows an example of a payment transaction from a one-time anonymous address of an infrastructure user to a payment address of an infrastructure provider. In the example, a payment for using a specific service (e.g., using an express lane of a road or using a parking spot) is transmitted from address 3 115, which is a one-time anonymous address of the infrastructure user, to payment address 1 121, which is a payment address for the specific service provided by the infrastructure provider. The payment amount is in accordance to a fixed or variable rate published by the infrastructure provider in real-time. On distributed ledger 212, the payment transaction is executed and recorded. Transaction record 211 is for this payment transaction. In a message field of transaction record 211, there is a hash of a license plate number (LPN) of the car used by the infrastructure user and a one-time random number (RN); for example, SHA256 (LPN, RN). SHA256 is a cryptographic hash function in SHA-2 (Secure Hash Algorithm 2) which is a set of cryptographic hash functions. It should be appreciated that the embodiment shows only an example of the cryptographic hash function or the algorithm and many other cryptographic hash functions or algorithms can be used. Transaction record 211 also shows that the transaction, for example, is transmitted from address 3 115 to payment address 1 121.

FIG. 2 shows distributed ledger 212. On distributed ledger 212, transactions of payments for using infrastructure services can be executed and recorded. For example, the transaction transmitted from address 3 115 to payment address 1 121 is executed and recorded on distributed ledger 212. Transaction record 211 is recorded on distributed ledger 212. FIG. 2 also shows verifier 213. Verifier 213 continuously monitors payment transactions on distributed ledger 212, and verifier 213 verifies the transactions with the one-time random numbers generated for the transactions and information of vehicles used by the infrastructure users who make payment transactions for using the infrastructure services.

Figure 3:
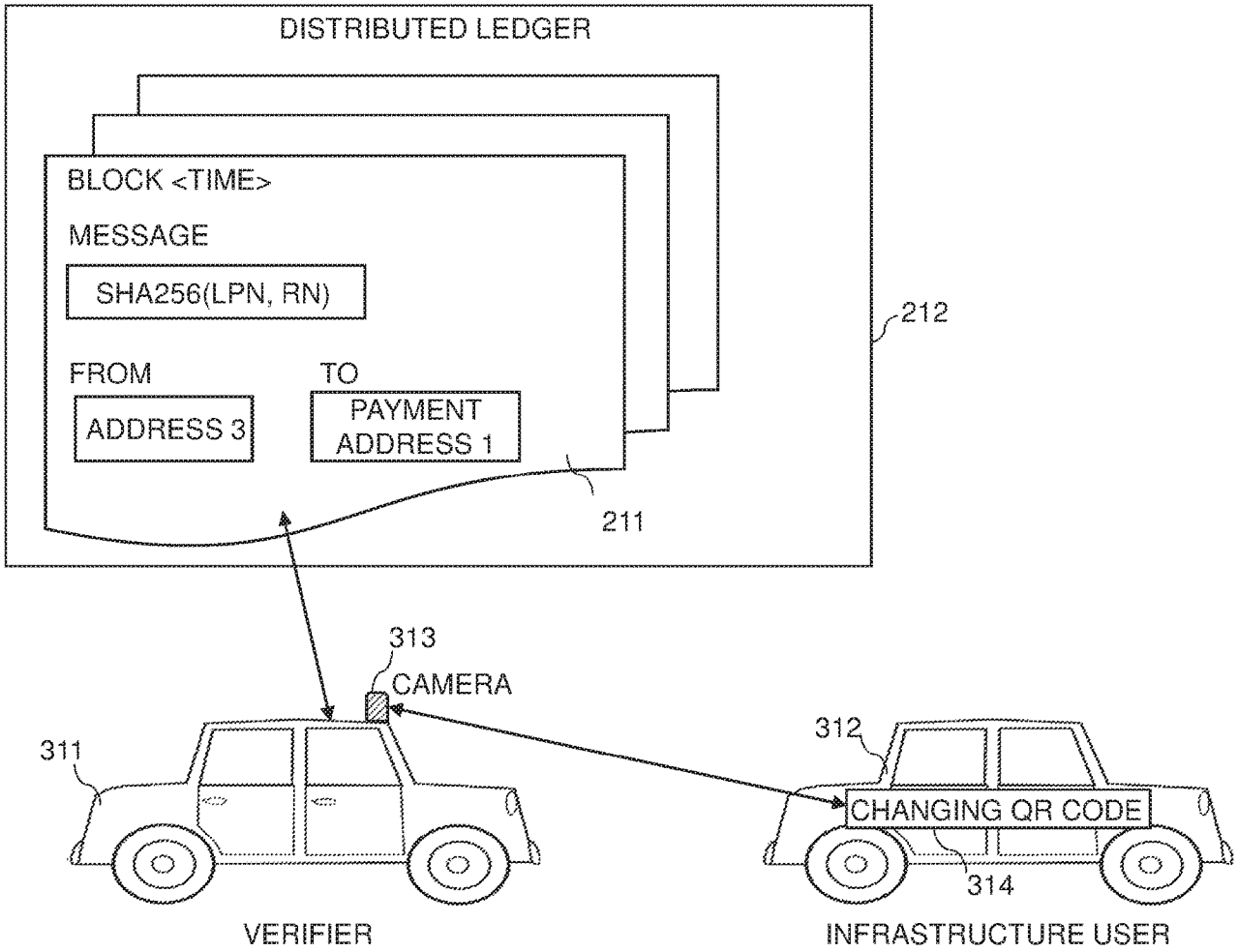
FIG. 3 is a diagram showing that a payment transaction from an infrastructure user to an infrastructure provider is verified by a verifier, in accordance with one embodiment of the present invention.

FIG. 3 is a diagram showing that a payment transaction from an infrastructure user to an infrastructure provider is verified by a verifier, in accordance with one embodiment of the present invention. The payment transaction from an infrastructure user to an infrastructure provider is executed and recorded on distributed ledger 212. As an example, FIG. 3 shows verifier's vehicle 311 and infrastructure user's vehicle 312.

When infrastructure user's vehicle 312 uses a specific service (e.g., using an express lane of a road or using a parking spot), a payment for the service is executed and recorded on distributed ledger 212. For example, the transaction shown in FIG. 2, which is from address 3 115 (a one-time anonymous address for the infrastructure user) to payment address 1 121 (a payment address for the specific service of the infrastructure provider) is executed on distributed ledger 212 and recorded as transaction record 211. Infrastructure user's vehicle 312 locally broadcasts the random number (RN) for this transaction as well as the current time. This can be implemented via a wireless communication protocol or via a form of a physical display next to the license plate number of infrastructure user's vehicle 312. In the example shown in FIG. 3, changing Quick Response (QR) code 314 is used by infrastructure user's vehicle 312. Here, the RN is required to ensure privacy beyond the direct physical neighborhood. The current time is required to prevent certain types of attacks.

Verifier's vehicle 311 monitors and downloads payment transactions on distributed ledger 212. Verifier's vehicle 311 parses for a valid transaction that has happened after the last fee schedule update, but before the current time. For a transaction to be labeled as valid, it must contain a message of the hash of the license plate number (LPN) and the random number (RN) for this transaction, and it also must contain the fee paid correspond to the service consumed.

In the example shown FIG. 3, verifier's vehicle 311 includes camera 313. Verifier's vehicle 311 records the license plate number (LPN), random numbers (RN), and the current time of infrastructure user's vehicle, using existing well known optical character recognition techniques.

Figure 4:
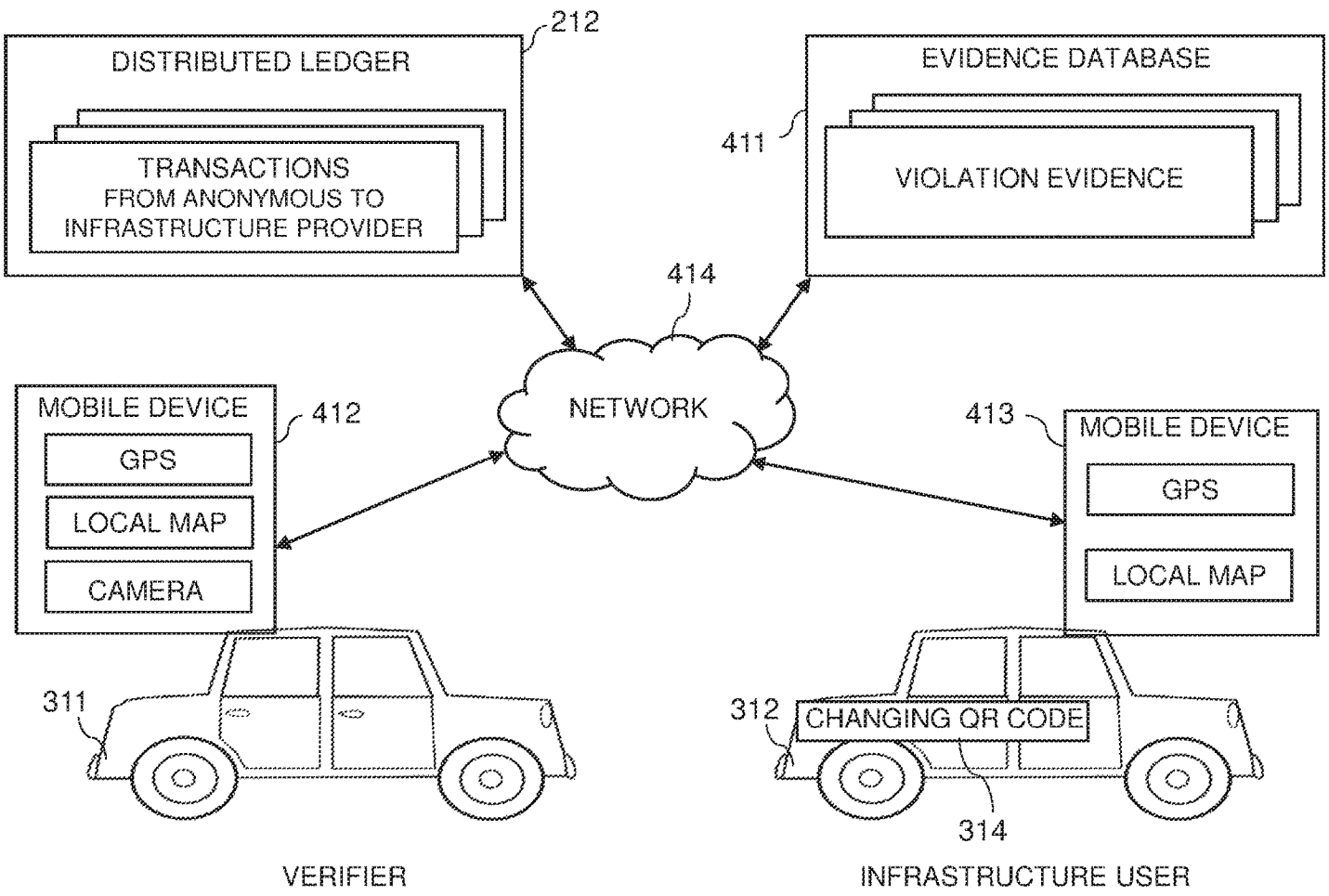
FIG. 4 is a diagram showing a system for monitoring and enforcement of an automated fee payment, in accordance with one embodiment of the present invention.

FIG. 4 is a diagram showing a system for monitoring and enforcement of an automated fee payment, in accordance with one embodiment of the present invention. In the embodiment, the system for monitoring and enforcement of an automated fee payment includes distributed ledger 212 where the payments transaction are executed and recorded and evidence database 411 where violation evidence is stored. The system further includes verifier's vehicle 311 and infrastructure user's vehicle 312. Verifier's vehicle 311 includes mobile device 412. Infrastructure user's vehicle 312 includes mobile device 413 and changing QR code 314. Distributed ledger 212, evidence database 411, mobile device 412, and mobile device 413 are interconnected by network 414.

In one embodiment shown in FIG. 4, camera 313 included in mobile device 412 of verifier's vehicle 311 is used to capture the license plate number (LPN), the random numbers (RN), and the current time of infrastructure user's vehicle displayed via changing QR code 314. In other embodiments, the license plate number (LPN) and the random numbers (RN) may be broadcasted via a wireless communication protocol. Functions of mobile device 412 of verifier's vehicle 311 includes but not limit to determining a current location, creating a map of the current location, capturing information of infrastructure user's vehicle 312 and information of payment transaction such as the one-time random numbers (RN), monitoring and downloading payment transactions including transaction record 211 on distributed ledger 212. If no valid transaction of infrastructure user's vehicle 312 is found on distributed ledger 212, mobile device 412 of verifier's vehicle 311 sends a violation record with a hash of the violation evidence to the infrastructure provider or other authorities. The evidence may include an image or a short video sequence of an offending situation. Mobile device 412 of verifier's vehicle 311 sends violation evidence to evidence database 411.

Functions of mobile device 413 of infrastructure user's vehicle 312 includes but not limit to determining a current location, creating a map of the current location of infrastructure user's vehicle 312, sending a payment to distributed ledger 212, broadcasting information of infrastructure user's vehicle 312 such as the license plate number (LPN) and information of the payment transaction such as the one-time random numbers (RN). In one embodiment shown in FIG. 4, changing Quick Response (QR) code 314 displayed on infrastructure user's vehicle 312 shows the license plate number (LPN) and the random numbers (RN), which are captured by mobile device 412 of verifier's vehicle 311. In other embodiments, the license plate number (LPN) and the random numbers (RN) may be broadcasted via a wireless communication protocol.

Figure 5:
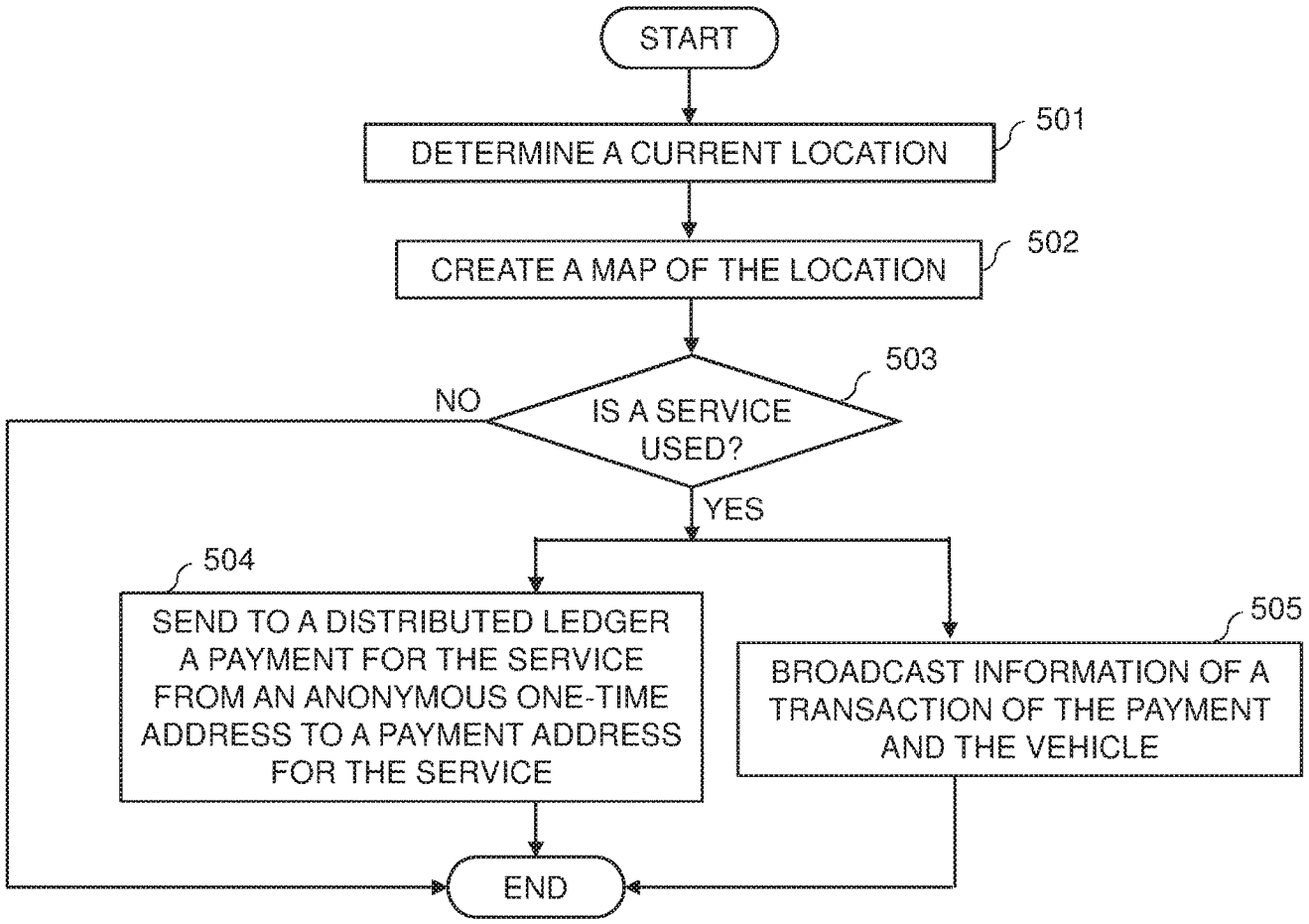
FIG. 5 is a flowchart showing operating steps of a mobile device on a vehicle used by an infrastructure user, in accordance with one embodiment of the present invention.

FIG. 5 is a flowchart showing operating steps of mobile device 413 on infrastructure user's vehicle 312, in accordance with one embodiment of the present invention. At step 501, mobile device 413 determines a current location of infrastructure user's vehicle 312. At step 502, mobile device 413 creates a map of the current location. At step 503 (decision block 503), mobile device 413 on infrastructure user's vehicle 312 determines whether a service provided by an infrastructure provider is used. The service may be an express lane of a road or a parking spot. In response to determining that the service is not used (NO branch of the decision block 503), the steps are ended. In response to determining that the service is used (YES branch of the decision block 503), at step 504, mobile device 413 on infrastructure user's vehicle 312 sends to distributed ledger 212 a payment for the service form an anonymous one-time address to a payment address for the service. At step 505, mobile device 413 on infrastructure user's vehicle 312 broadcasts information of the transaction of the payment and information of infrastructure user's vehicle 312. The information includes a license plate number (LPN) of infrastructure user's vehicle 312, a one-time random number (RN) for this transaction, and current time. In one embodiment, changing Quick Response (QR) code 314 displayed on infrastructure user's vehicle 312 shows the license plate number (LPN) and the random numbers (RN. In another embodiment, the license plate number (LPN) and the random numbers (RN) may be broadcasted via a wireless communication protocol.

Figure 6:
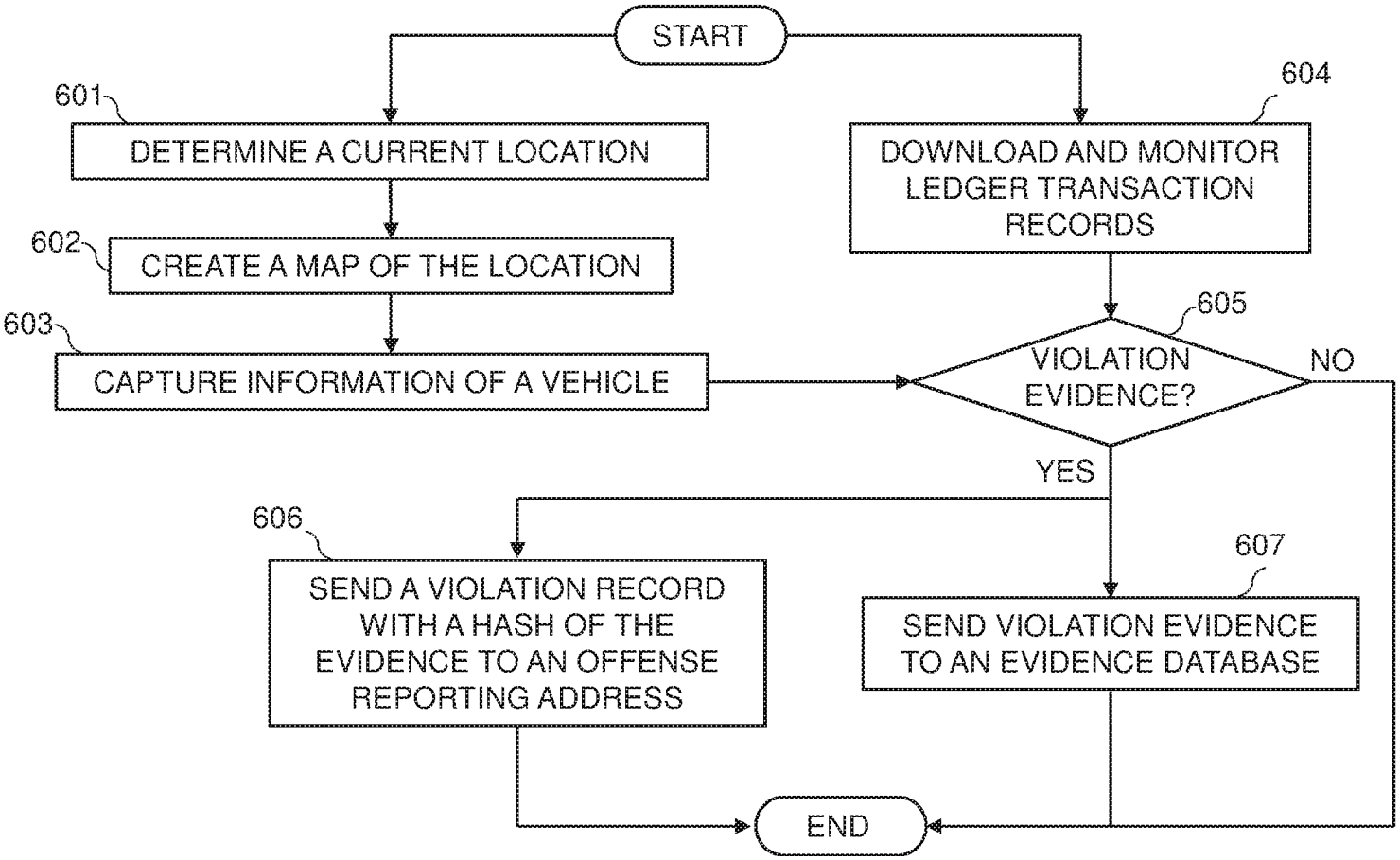
FIG. 6 is a flowchart showing operating steps of a mobile device on a vehicle used by a verifier, in accordance with one embodiment of the present invention.

FIG. 6 is a flowchart showing operating steps of mobile device 412 on verifier's vehicle 311, in accordance with one embodiment of the present invention. At step 601, mobile device 412 determines a current location of infrastructure user's vehicle 312. At step 602, mobile device 412 on verifier's vehicle 311 creates a map of the current location. At step 603, mobile device 412 on verifier's vehicle 311 captures information of a payment transaction and infrastructure user's vehicle 312. The information may include a license plate number (LPN), a one-time random number (RN) for this transaction, and current time. The information is broadcasted by mobile device 413 on infrastructure user's vehicle 312. Verifier's vehicle 311 uses camera 313 or other sensors to capture the information, using existing well known optical character recognition techniques. At step 604, mobile device 412 on verifier's vehicle 311 downloads and monitors payment records on distributed ledger 212.

After steps 603 and 604, mobile device 412 on verifier's vehicle 311, at step 605, determines whether there is violation evidence. At this step 605 (decision block 605), mobile device 412 on verifier's vehicle 311 determines whether a valid transaction of infrastructure user's vehicle 312 is found on distributed ledger 212. In response to determining that there is no violation evidence or a valid transaction of infrastructure user's vehicle 312 is found on distributed ledger 212 (NO branch of decision block 605), the steps are ended. In response to determining that there is violation evidence or a valid transaction of infrastructure user's vehicle 312 is not found on distributed ledger 212 (YES branch of decision block 605), mobile device 412 on verifier's vehicle 311 executes steps 606 and 607. At step 606, mobile device 412 on verifier's vehicle 311 sends a violation record with a hash of the violation evidence to an offense reporting address of the infrastructure provider. At step 607, mobile device 412 on verifier's vehicle 311 sends violation evidence to evidence database 411. The violation evidence may include an image or a short video sequence of an offending situation.

Figure 7:
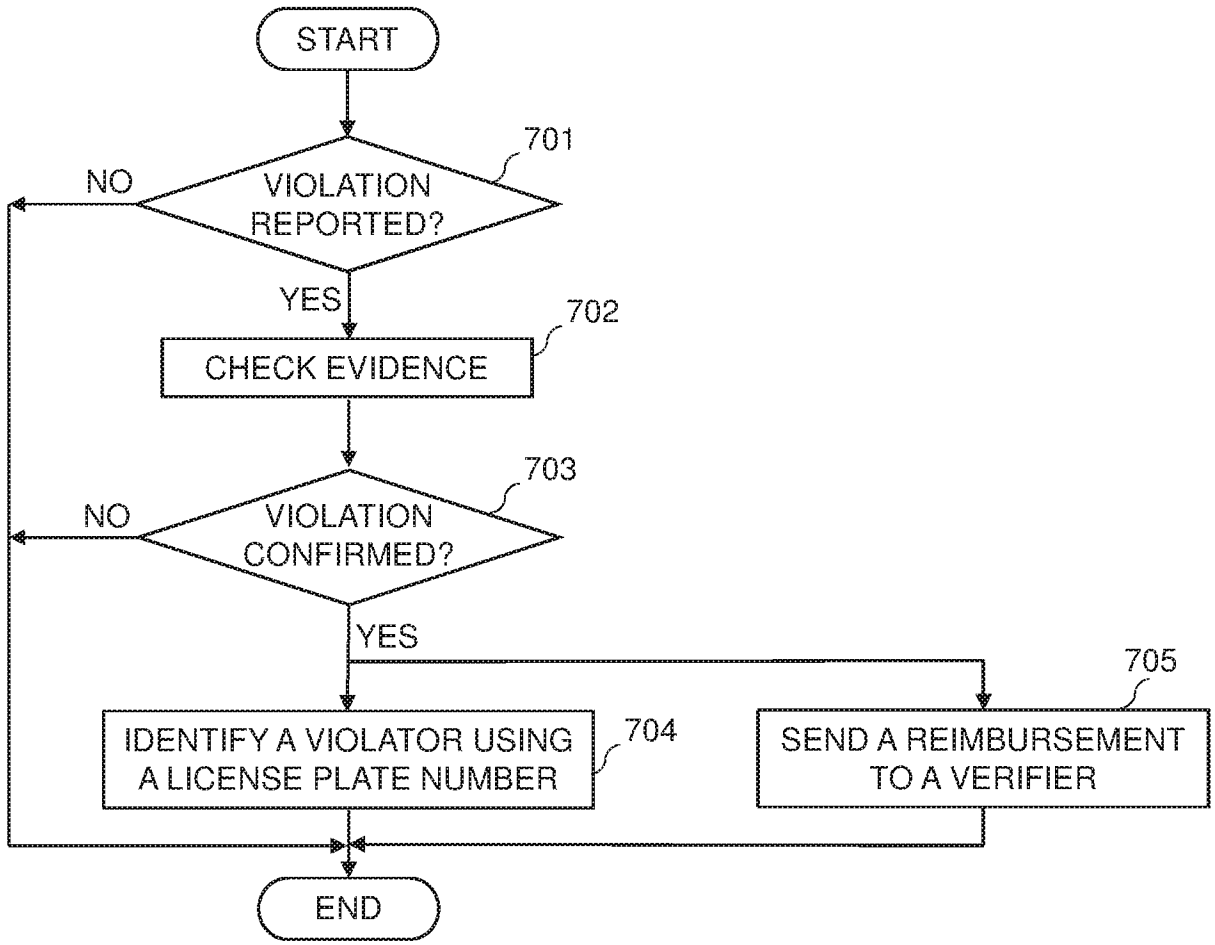
FIG. 7 is a flowchart showing operating steps of a computer device of an infrastructure provider, in accordance with one embodiment of the present invention.

FIG. 7 is a flowchart showing operating steps of a computer device of an infrastructure provider, in accordance with one embodiment of the present invention. At step 701 (decision block 701), the computer device of the infrastructure provider determines whether a violation is reported. As described previously, if no valid transaction of infrastructure user's vehicle 312 is found on distributed ledger 212, mobile device 412 on verifier's vehicle 311 sends a violation record with a hash of the violation evidence. In response to determining that no violation is reported (NO branch of decision block 701), the steps are ended. In response to determining that the violation is reported (YES branch of decision block 701), the computer device of the infrastructure provider checks evidence by checking the violation record in which the hash of the violation evidence is embedded. Then, at step 703 (decision block 703), the computer device of the infrastructure provider determines whether the violation is confirmed. In response to determining that the violation is not confirmed (NO branch of decision block 703), the steps are ended. In response to determining that the violation is confirmed (YES branch of decision block 703), at step 704, the computer device of the infrastructure provider identifies a violator using the license plate number (LPN). Optionally, at step 705, the computer device of the infrastructure provider sends reimbursement to the verifier.

Figure 8:
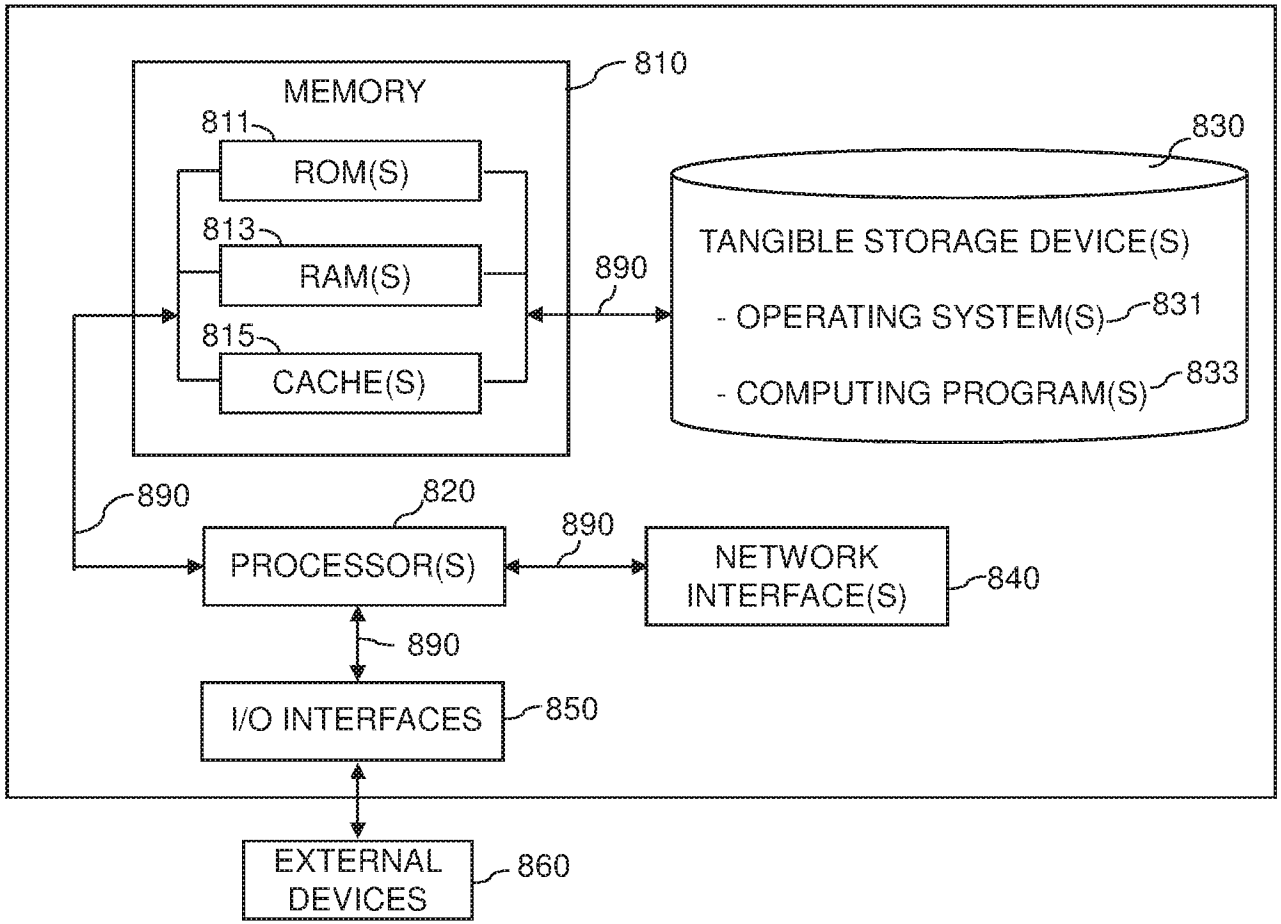
FIG. 8 is a diagram illustrating components of a mobile device on a vehicle used by an infrastructure user, a mobile device on a vehicle used by a verifier, or a computer device of an infrastructure provider, in accordance with one embodiment of the present invention.

FIG. 8 is a diagram illustrating components of components of a mobile device on a vehicle used by an infrastructure user, a mobile device on a vehicle used by a verifier, or a computer device of an infrastructure provider, in accordance with one embodiment of the present invention. It should be appreciated that FIG. 8 provides only an illustration of one implementation and does not imply any limitations with regard to the environment in which different embodiments may be implemented.

Referring to FIG. 8, computer device 800 includes processor(s) 820, memory 810, and tangible storage device(s) 830. In FIG. 8, communications among the above-mentioned components of computer device 800 are denoted by numeral 890. Memory 810 includes ROM(s) (Read Only Memory) 811, RAM(s) (Random Access Memory) 813, and cache(s) 815. One or more operating systems 831 and one or more computer programs 833 reside on one or more computer readable tangible storage device(s) 830. Computer device 800 further includes I/O interface(s) 850. I/O interface(s) 850 allows for input and output of data with external device(s) 860 that may be connected to computer device 800. Computer device 800 further includes network interface(s) 840 for communications between computer device 800 and a computer network.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device, such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network (LAN), a wide area network (WAN), and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++, and conventional procedural programming languages, such as the "C" programming language, or similar programming languages. The computer readable program instructions may execute entirely on the user's computer, partly on the user's computer, as a stand-alone software package, partly on the user's computer and partly on a remote computer, or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture, including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus, or other device to produce a computer implemented process, such that the instructions which execute on the computer, other programmable apparatus, or other device implement the functions/acts specified in the flowchart and/or block diagram block or blocks.

The flowchart and block diagrams in the FIGs illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the FIGs. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A method for monitoring and enforcing an automated fee payment in an infrastructure, the method comprising:

monitoring, by a mobile device on a vehicle of a verifier, a record of transactions of payments on a distributed ledger, wherein the payments are paid for using a service of the infrastructure and paid by a mobile device on a vehicle of an infrastructure user, wherein a respective one of the payments is sent in an electronic payment system from an anonymous one-time address of the infrastructure user to a payment address of an infrastructure provider, wherein the electronic payment system generates a random number for a transaction of the respective one of the payments, wherein the record of the transactions of the payments on the distributed ledger includes a hash of the random number for the transaction of the respective one of the payments and a license plate number of the vehicle of an infrastructure user;

downloading from the distributed ledger, by the mobile device on the vehicle of the verifier, the record of the transactions;

parsing, by the mobile device on the vehicle of the verifier, for a valid transaction that has happened after a last fee schedule update;

capturing, by a camera on the vehicle of the verifier, the random number and the license plate number, wherein the random number and the license plate number are shown by a changing Quick Response code displayed on the vehicle of the infrastructure user;

determining, by the mobile device on the vehicle of the verifier, whether the valid transaction is found on the distributed ledger; and sending, by the mobile device on the vehicle of the verifier, a violation record to an offense reporting address of the infrastructure provider, in response to determining that no valid transaction is found on the distributed ledger.

2. The method of claim 1, further comprising:

sending, by the mobile device on the vehicle of the verifier, violation evidence to an evidence database of the infrastructure provider, in response to determining that no valid transaction is found on the distributed ledger.

3. The method of claim 1, wherein the record of the transactions includes times of the transactions.

4. The method of claim 1, wherein the violation record include a hash of evidence.

5. The method of claim 1, further comprising:

determining, by the mobile device on the vehicle of the infrastructure user, whether the service of the infrastructure is used;

sending, by the mobile device on the vehicle of the infrastructure user, to the distributed ledger, the payment for using the service; and broadcasting, by the mobile device on the vehicle of the infrastructure user, the random number and the license plate number, wherein the random number and the license number are shown by the changing Quick Response code displayed on the vehicle of the infrastructure user.

6. The method of claim 1, further comprising:

receiving, by a computer of the infrastructure provider, from the mobile device on the vehicle of the verifier, the violation record;

confirming, by the computer of the infrastructure provider, the violation record by checking an evidence database of the infrastructure provider; and identifying, by the computer of the infrastructure provider, a violator based on the license plate number of the vehicle of the infrastructure user.

7. A computer program product for monitoring and enforcing an automated fee payment in an infrastructure, the computer program product comprising a computer readable storage medium having program code embodied therewith, the program code executable to:

monitor, by a mobile device on a vehicle of a verifier, a record of transactions of payments on a distributed ledger, wherein the payments are paid for using a service of the infrastructure and paid by a mobile device on a vehicle of an infrastructure user, wherein a respective one of the payments is sent in an electronic payment system from an anonymous one-time address of the infrastructure user to a payment address of an infrastructure provider, wherein the electronic payment system generates a random number for a transaction of the respective one of the payments, wherein the record of the transactions of the payments on the distributed ledger includes a hash of the random number for the transaction of the respective one of the payments and a license plate number of the vehicle of an infrastructure user;

download from the distributed ledger, by the mobile device on the vehicle of the verifier, the record of the transactions;

parse, by the mobile device on the vehicle of the verifier, for a valid transaction that has happened after a last fee schedule update;

capture, by a camera on the vehicle of the verifier, the random number and the license plate number, wherein the random number and the license plate number are shown by a changing Quick Response code displayed on the vehicle of the infrastructure user;

determine, by the mobile device on the vehicle of the verifier, whether the valid transaction is found on the distributed ledger; and send, by the mobile device on the vehicle of the verifier, a violation record to an offense reporting address of the infrastructure provider, in response to determining that no valid transaction is found on the distributed ledger.

8. The computer program product of claim 7, further comprising the program code executable to:

send, by the mobile device on the vehicle of the verifier, violation evidence to an evidence database of the infrastructure provider, in response to determining that no valid transaction is found on the distributed ledger.

9. The computer program product of claim 7, wherein the record of the transactions includes times of the transactions.

10. The computer program product of claim 7, wherein the violation record include a hash of evidence.

11. The computer program product of claim 7, further comprising the program code executable to:

determine, by the mobile device on the vehicle of the infrastructure user, whether the service of the infrastructure is used;

send, by the mobile device on the vehicle of the infrastructure user, to the distributed ledger, the payment for using the service; and broadcast, by the mobile device on the vehicle of the infrastructure user, the random number and the license plate number, wherein the random number and the license number are shown by the changing Quick Response code displayed on the vehicle of the infrastructure user.

12. The computer program product of claim 7, further comprising the program code executable to:

receive, by a computer of the infrastructure provider, from the mobile device on the vehicle of the verifier, the violation record;

confirm, by the computer of the infrastructure provider, the violation record by checking an evidence database of the infrastructure provider; and identify, by the computer of the infrastructure provider, a violator based on the license plate number of the vehicle of the infrastructure user.

13. A computer system for monitoring and enforcing an automated fee payment in an infrastructure, the computer system comprising:

one or more processors, one or more computer readable tangible storage devices, and program instructions stored on at least one of the one or more computer readable tangible storage devices for execution by at least one of the one or more processors, the program instructions executable to:

monitor, by a mobile device on a vehicle of a verifier, a record of transactions of payments on a distributed ledger, wherein the payments are paid for using a service of the infrastructure and paid by a mobile device on a vehicle of an infrastructure user, wherein a respective one of the payments is sent in an electronic payment system from an anonymous one-time address of the infrastructure user to a payment address of an infrastructure provider, wherein the electronic payment system generates a random number for a transaction of the respective one of the payments, wherein the record of the transactions of the payments on the distributed ledger includes a hash of the random number for the transaction of the respective one of the payments and a license plate number of the vehicle of an infrastructure user;

download from the distributed ledger, by the mobile device on the vehicle of the verifier, the record of the transactions;

parse, by the mobile device on the vehicle of the verifier, for a valid transaction that has happened after a last fee schedule update;

capture, by a camera on the vehicle of the verifier, the random number and the license plate number, wherein the random number and the license plate number are shown by a changing Quick Response code displayed on the vehicle of the infrastructure user;

determine, by the mobile device on the vehicle of the verifier, whether the valid transaction is found on the distributed ledger; and send, by the mobile device on the vehicle of the verifier, a violation record to an offense reporting address of the infrastructure provider, in response to determining that no valid transaction is found on the distributed ledger.

14. The computer system of claim 13, further comprising the program instructions executable to:

send, by the mobile device on the vehicle of the verifier, violation evidence to an evidence database of the infrastructure provider, in response to determining that no valid transaction is found on the distributed ledger.

15. The computer system of claim 13, wherein the record of the transactions includes times of the transactions.

16. The computer system of claim 13, wherein the violation record include a hash of evidence.

17. The computer system of claim 13, further comprising the program instructions executable to:

determine, by the mobile device on the vehicle of the infrastructure user, whether the service of the infrastructure is used;

send, by the mobile device on the vehicle of the infrastructure user, to the distributed ledger, the payment for using the service; and broadcast, by the mobile device on the vehicle of the infrastructure user, the random number and the license plate number, wherein the random number and the license number are shown by the changing Quick Response code displayed on the vehicle of the infrastructure user.

18. The computer system of claim 13, further comprising the program instructions executable to:

receive, by a computer of the infrastructure provider, from the mobile device on the vehicle of the verifier, the violation record;

confirm, by the computer of the infrastructure provider, the violation record by checking an evidence database of the infrastructure provider; and identify, by the computer of the infrastructure provider, a violator based on the license plate number of the vehicle of the infrastructure user.

* * * * *